US010618287B2

(12) United States Patent
Ishizuka

(10) Patent No.: US 10,618,287 B2
(45) Date of Patent: Apr. 14, 2020

(54) LIQUID EJECTION HEAD, METHOD FOR MANUFACTURING THE SAME, AND RECORDING METHOD

(71) Applicant: CANON KABUSHIKI KAISHA, Tokyo (JP)

(72) Inventor: Kazunari Ishizuka, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/051,260

(22) Filed: Jul. 31, 2018

(65) Prior Publication Data

US 2019/0039376 A1 Feb. 7, 2019

(30) Foreign Application Priority Data

Aug. 3, 2017 (JP) ..... 2017-151039
Jun. 11, 2018 (JP) ..... 2018-111475

(51) Int. Cl.
*B41J 2/16* (2006.01)

(52) U.S. Cl.
CPC ..... *B41J 2/1631* (2013.01); *B41J 2/1603* (2013.01); *B41J 2/1606* (2013.01); *B41J 2/1626* (2013.01); *B41J 2/1639* (2013.01); *B41J 2/1645* (2013.01)

(58) Field of Classification Search
CPC ..... B41J 2/1606
See application file for complete search history.

(56) References Cited

U.S. PATENT DOCUMENTS

2010/0302326 A1* 12/2010 Morohoshi ..... B41J 2/1433 347/86
2017/0274652 A1* 9/2017 Tamai ..... B41J 2/1433
2017/0368819 A1* 12/2017 Kagata ..... B41J 2/04563

FOREIGN PATENT DOCUMENTS

| | | | | |
|---|---|---|---|---|
| JP | 60-161973 A | 8/1985 | | |
| JP | 63-221121 A | 9/1988 | | |
| JP | 64-9216 A | 1/1989 | | |
| JP | 2-140219 A | 5/1990 | | |
| JP | 2007-518587 A | 7/2007 | | |
| JP | 2011-206628 A | 10/2011 | | |
| WO | WO-2005007413 A1 * | 1/2005 | ..... | B41J 2/1631 |

* cited by examiner

*Primary Examiner* — Scott A Richmond
(74) *Attorney, Agent, or Firm* — Canon USA, Inc., IP Division

(57) ABSTRACT

A liquid ejection head includes an ejection opening member having an ejection opening through which a liquid is ejected. The ejection opening member is provided with a cured layer of a composition over the surface thereof. The composition contains (a) a condensate of a hydrolyzable silane compound having a fluorine-containing group and a hydrolyzable silane compound having a cationically polymerizable group, and (b) a compound having a cationically polymerizable group and an ethylene oxide chain.

7 Claims, 3 Drawing Sheets

LIQUID EJECTION HEAD, METHOD FOR MANUFACTURING THE SAME, AND RECORDING METHOD

BACKGROUND OF THE INVENTION

Field of the Invention

The present disclosure relates to a liquid ejection head configured to eject a liquid and, more specifically, to an ink jet recording head configured to eject ink onto a recording medium for recording.

Description of the Related Art

A liquid ejection head such as an ink jet recording head typically includes a substrate provided with an energy generating element capable of generating energy used for ejecting a liquid, and an ejection opening member having an ejection opening through which the liquid is ejected.

The liquid ejection from a liquid ejection head of this type is considerably affected by the surface condition of the ejection opening member. Accordingly, the ejection opening member is provided with a liquid-repellent layer over the surface thereof to suppress the attachment of liquid and maintain a constant surface condition. PCT Japanese Translation Patent Publication No. 2007-518587 discloses a liquid-repellent layer containing a condensate of a hydrolyzable silane compound having a fluorine-containing group and a hydrolyzable silane compound having a cationically polymerizable group.

In recent years, a variety of ingredients have been being added to the liquid from the viewpoint of further improving recording quality. This tends to cause the liquid to adhere to the liquid-repellent layer due to unexpected reasons. For example, an ink in which a pigment is dispersed with a high content is used in some cases from the viewpoint of improving recording quality. If a liquid ejection head is operated with such an ink for a long time, electrostatic charges locally accumulated at the surface of the liquid-repellent layer often cause the pigment particles in the ink to aggregate and adhere to the surface.

PCT Japanese Translation Patent Publication No. 2007-518587 also discloses that the adhesion of ink can be reduced by adding an electrically conductive compound, such as carbon black, to the liquid-repellent layer to diselectrify the liquid-repellent layer.

The present inventors, however, have found that it is difficult for the liquid-repellent layer containing a conductive compound to constantly suppress the adhesion of ink over a long time. The surface of the liquid-repellent layer is subjected to rinsing with liquid or wiping with a rubber blade to remove ink therefrom at regular intervals. The cleaning or wiping removes the conductive compound from the liquid-repellent layer, reducing the antistatic property of the liquid-repellent layer.

SUMMARY OF THE INVENTION

According to an aspect of the present disclosure, there is provided a liquid ejection head including an ejection opening member having an ejection opening through which a liquid is ejected. The ejection opening member is provided with a cured layer of a composition over the surface thereof. The composition of the cured layer contains (a) a condensate of a hydrolyzable silane compound having a fluorine-containing group and a hydrolyzable silane compound having a cationically polymerizable group, and (b) a compound having a cationically polymerizable group and an ethylene oxide chain.

Further features of the present disclosure will become apparent from the following description of exemplary embodiments with reference to the attached drawings.

DESCRIPTION OF THE EMBODIMENTS

Figure 1:
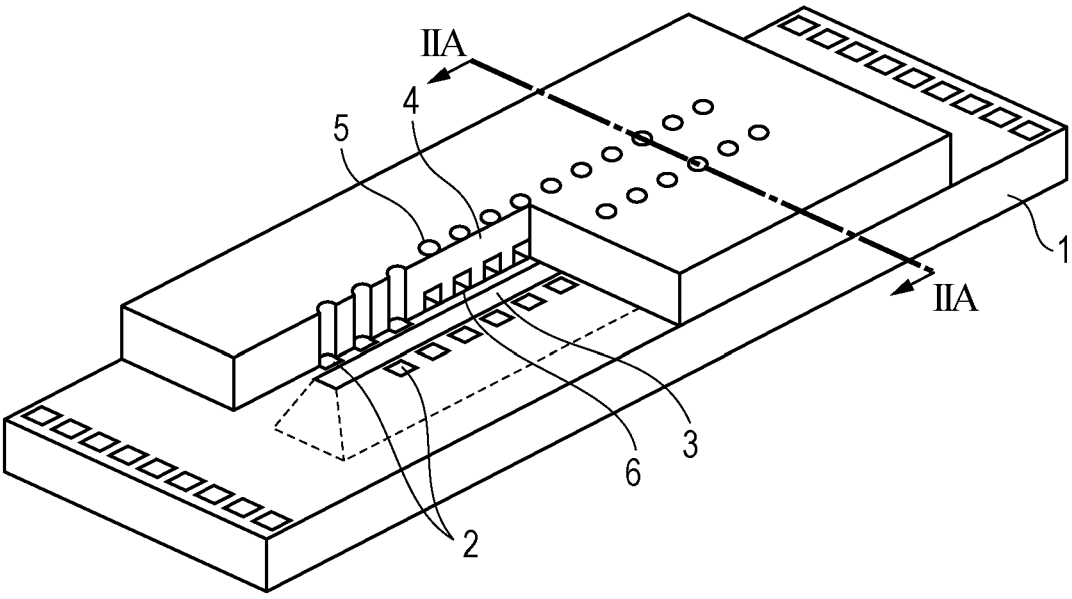
FIG. 1 is a schematic perspective view of a liquid ejection head according to an embodiment of the present disclosure.

The present disclosure provides a liquid ejection head in which the antistatic property of the liquid-repellent layer disposed over the surface of the ejection opening member can be maintained so as to suppress the adhesion of liquid to the liquid-repellent layer over a long time, and a method for manufacturing the liquid ejection head.

The present disclosure also provides a recording method that can suppress the adhesion of liquid to the liquid-repellent layer of the liquid ejection head and thus can maintain high recording quality over a long time.

The liquid ejection head according to the present disclosure includes an ejection opening member having an ejection opening through which a liquid is ejected. The ejection opening member is provided with a cured layer of a composition over the surface thereof. The composition of the cured layer contains (a) a condensate of a hydrolyzable silane compound having a fluorine-containing group and a hydrolyzable silane compound having a cationically polymerizable group, and (b) a compound having a cationically polymerizable group and an ethylene oxide chain. Component (a) is repellent to liquid, and component (b) is a compound capable of imparting an antistatic property to the liquid-repellent layer because of the presence of the ethylene oxide chain. Since the components (a) and (b) each have a cationically polymerizable group, the antistatic compound, or component (b), is incorporated into the condensate, or component (a), by a curing reaction of the cationically polymerizable groups. Consequently, the antistatic compound becomes difficult to remove from the liquid-repellent layer even though the surface of the liquid ejection head is subjected to rinsing or wiping, and, thus, the liquid-repellent layer can maintain an antistatic property for a long time.

On the other hand, in a liquid-repellent layer containing an electrically conductive compound as an antistatic compound as disclosed in Japanese Patent Laid-Open No. 2011-206628, the conductive compound is easily removed by rinsing or wiping the surface of the liquid ejection head. Thus, the antistatic property is gradually reduced through a long-time use.

A generally used surfactant, such as an anionic surfactant, a cationic surfactant, an amphoteric surfactant, or a nonionic surfactant, may also be used as the antistatic compound. Surfactants are hydrophilic and absorb moisture from air, thus functioning to prevent static electricity. However, water or moisture on the surface of the liquid ejection head is removed by rinsing or wiping for cleaning, and the antistatic function of the surfactant is lost. It is therefore difficult for the surfactant to maintain an antistatic property of the liquid-repellent layer. A large amount of a surfactant may be added to the liquid-repellent layer so that the antistatic property can be maintained. However, this may adversely affect liquid repellency.

The liquid-repellent layer of the liquid ejection head according to the present disclosure contains an antistatic compound in a fixed state as described above, thus constantly suppressing the adhesion of liquid for a long time.

Exemplary embodiments of the subject matter disclosed herein will now be described with reference to the drawings.

Although the following embodiment of the liquid ejection head of the present disclosure is implemented as an ink jet recording head (hereinafter simply referred to as the recording head), many other embodiments may be made without being limited to the disclosed embodiment. For example, the liquid ejection head can be used in various types of apparatuses, such as printers, copy machines, facsimile machines including a communication system, and word processors including a printing portion, and, in addition, used in industrial recording apparatuses combined with processing devices.

The "recording medium" mentioned herein refers to a medium that allows recording thereon and may be made of a variety of materials including paper, threads or strings, fiber, cloth, leather, metal, plastics, glass, wood, and ceramics. Also, the term "recording" mentioned herein refers to forming an image or a pattern that does not mean something on a recording medium, as well as to adding to the recording medium visual information that means something, such as letters, characters, figures, graphics, or diagrams. Furthermore, the term "ink" or "liquid" mentioned herein should be understood in a broad sense and refers to a liquid that is applied to a recording medium to form images, figures, patterns, or the like on the recording medium, or to process or treat the recording medium. The treatment of the recording medium is an operation intended to increase the fixability of the ink applied onto the recording medium by solidifying or insolubilizing the coloring material in the ink, to increase recording quality or color developability, or to increase the durability of recorded images.

Recording Head

FIG. 1 is a schematic view of a recording head according to an embodiment of the present disclosure.

The recording head includes a substrate 1 including energy generating elements 2 configured to generate energy used for ejecting liquid. The energy generating elements 2 are arranged in two lines at regular intervals. The substrate 1 has a liquid supply port 3 formed between the two lines of the energy generating elements 2. An ejection opening member 4 is disposed on the substrate 1. The ejection opening member 4 has ejection openings 5 formed therein so as to oppose the energy generating elements 2. The position of the ejection openings 5 is however not limited to that opposing the energy generating elements 2. The ejection opening member 4 also has a function as a member (flow channel member) in which flow channels 6 connecting the supply port 3 to the ejection openings 5 are formed. The substrate 1 is not particularly limited in terms of the shape, the material, or the like as long as the substrate 1 functions as part of a member defining the flow channels 6 at the surface thereof and as a support of the ejection opening member 4. In the present embodiment, a silicon substrate is used as the substrate 1 so that the supply port 3 can be formed by anisotropic etching as will be described herein later.

The recording head will be arranged in such a manner that the surface thereof defining the open ends of the ejection openings 5 opposes the surface subjected to recording of the recording medium. Then, the energy generating elements 2 apply energy to the ink delivered to the flow channels 6 through the supply port 3 to eject ink droplets through the ejection openings 5. Recording is thus performed by applying the ink onto the recording medium. The energy generating element 2 may be an electrothermal conversion element (what is called a heater) or the like that generates thermal energy or a piezoelectric element or the like that generates mechanical energy.

Figure 2A:
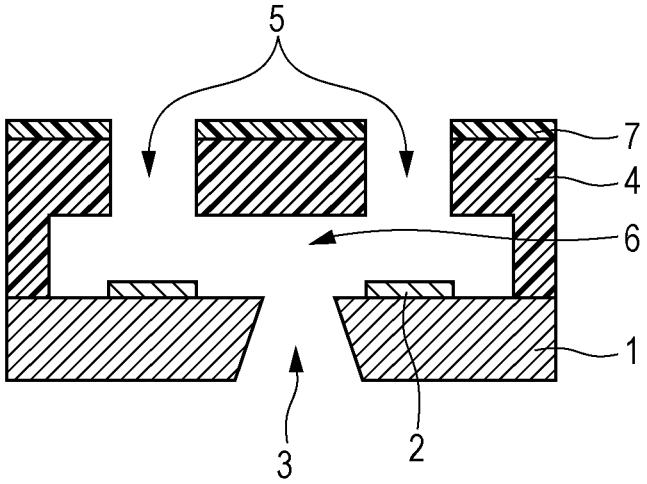
FIGS. 2A and 2B are each a schematic sectional view of a liquid ejection head according to an embodiment of the present disclosure.
Figure 2B:
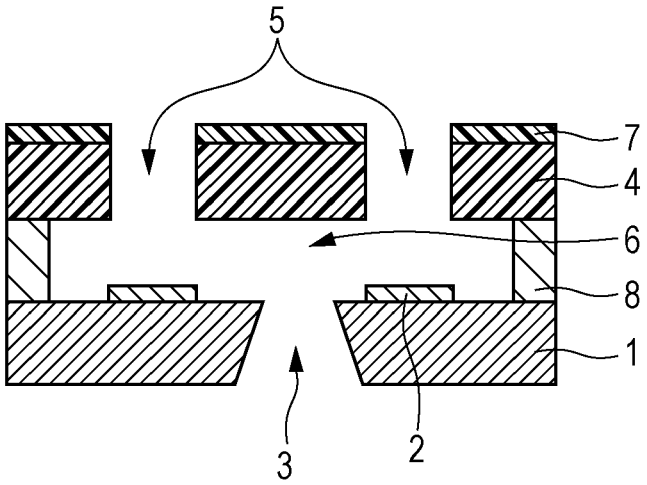

FIG. 2A is a sectional view of the recording head viewed in section perpendicular to the substrate 1, taken along line IIA-IIA shown in FIG. 1. The recording head may further include a flow channel member 8 acting as the walls of the flow channels 6 between the substrate 1 and the ejection opening member 4, as shown in FIG. 2B. The ejection openings 5 may be formed in a tapered shape whose cross section, parallel to the surface of the substrate 1, gradually decreases in the direction from the substrate 1 to the ejection opening 5.

The ejection opening member 4 is provided with a liquid-repellent layer 7 over the surface thereof as shown in FIGS. 2A and 2B. The liquid-repellent layer 7 prevents the ink ejected through the ejection openings 5 from attaching to the surface of the recording head. The liquid-repellent layer 7 is defined by a cured layer of a composition containing: (a) a condensate of a hydrolyzable silane compound having a fluorine-containing group and a hydrolyzable silane compound having a cationically polymerizable group (hereinafter often referred to simply as the condensate); and (b) a compound having a cationically polymerizable group and an ethylene oxide chain, as described above. The constituents of the composition forming the liquid-repellent layer 7 will now be described in detail.

(a) Condensate of a Hydrolyzable Silane Compound Having a Fluorine-Containing Group and a Hydrolyzable Silane Compound Having a Cationically Polymerizable Group Component (a) is repellent to liquid. The liquid-repellent layer 7 formed by curing the composition containing component (a) contains a siloxane skeleton (inorganic skeleton) formed from the hydrolyzable silane compounds and a skeleton formed by curing the cationically polymerizable group (organic skeleton, for example, ether skeleton in the case of using the epoxy group as the cationically polymerizable group). Component (a) thus forms what is called an organic-inorganic hybrid cured material, exhibiting high durability to wiping of the surface of the recording head. Also, component (a) contains a cationically polymerizable group and is sensitive to light used for photolithography patterning, enabling the ejection openings 5 to be precisely formed by patterning.

The fluorine-containing group of the hydrolyzable silane compound having a fluorine-containing group may be a group including a perfluoroalkyl or a perfluoropolyether group.

The hydrolyzable silane compound having a perfluoroalkyl group may be a compound represented by the following formula (9):

$$CF_3(CF_2)_n\text{-}A\text{-}SiX_aY_{3-a} \quad (9)$$

wherein in formula (9), A represents a divalent organic group, X represents a hydrolyzable substituent, and Y represents a nonhydrolyzable substituent, and wherein n represents an integer of 0 to 20, and a represents an integer of 1 to 3.

For example, the hydrolyzable substituent represented by X in formula (9) may be a methoxy group or an ethoxy group. In some embodiments, n may be an integer of 3 to 15, or an integer of 5 to 10. The divalent organic group represented by A may have a carbon number of 10 or less. In some embodiments, the divalent organic group may be a divalent alkylene or alkyleneoxy group having a carbon number of 6 or less, such as methylene, ethylene, propylene, butylene, methyleneoxy, ethyleneoxy, propyleneoxy, and butyleneoxy. The nonhydrolyzable substituent represented by Y may be an ethylene group.

The compounds represented by formula (9) include: $CF_3—C_2H_4—SiX_3$; $C_2F_5—C_2H_4—SiX_3$; $C_4F_9—C_2H_4—SiX_3$; $C_6F_{13}—C_2H_4—SiX_3$; $C_8F_{17}—C_2H_4—SiX_3$; and $C_{10}F_{21}—C_2H_4—SiX_3$. X represents a methoxy group or an ethoxy group.

In some embodiments, perfluorodecylethyltriethoxysilane ($C_8F_{17}—C_2H_4—Si(OC_2H_5)_3$) or tridecafluoro-1,1,2,2-tetrahydrooctyltriethoxysilane ($C_6F_{13}—C_2H_4—Si(OC_2H_5)_3$) may be used as the compound of formula (9).

The hydrolyzable silane compound having a perfluoropolyether group may be any one of the compounds represented by the following formulas (10) to (13):

$$F\text{-}Rp\text{-}A\text{-}SiX_aY_{3-a} \quad (10)$$

wherein in formula (10), Rp represents a perfluoropolyether group, A represents a divalent organic group, X represents a hydrolyzable substituent, Y represents a nonhydrolyzable substituent, and n represents an integer of 1 to 3;

$$R_{3-a}X_aSi\text{-}A\text{-}Rp\text{-}A\text{-}SiX_aY_{3-a} \quad (11)$$

wherein in formula (11), R represents a nonhydrolyzable substituent and may be the same as or different from Y, and wherein Rp, A, X, Y, and an each represent the same as in formula (10);

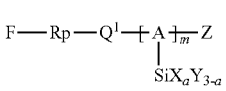

(12)

wherein in formula (12), Z represents a hydrogen atom or an alkyl group, and $Q^1$ represents a divalent linking member, and wherein m represents an integer of 1 to 4, and Rp, A, X, Y, and an each represent the same as in formula (10);

$$F\text{-}Rp\text{-}Q^2\text{-}(A\text{-}SiX_aY_{3-a})_n \quad (13)$$

wherein in formula (13), n represents an integer of 1 or 2, $Q^2$ represents a divalent linking member when n=1 or a trivalent linking member when n=2, and Rp, A, X, Y, and an each represent the same as in formula (10).

The perfluoropolyether group represented by Rp in formulas (10) to (13) may be a group represented by the following formula (14):

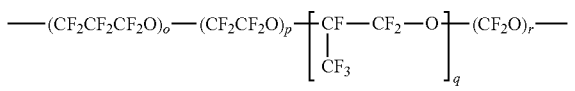

(14)

wherein in formula (14), o, p, q, and r each represent an integer of 0 to 30, and at least one of them is an integer of 2 or more.

Beneficially, o, p, q, and r of formula (14) are each an integer of 1 to 30. In view of liquid repellency and solubility in solvent, the sum of o, p, q, and r may be an integer of 3 to 10.

The number of repetitions of each repeating unit in Rp in formulas (10) to (13) may be an integer of 1 to 30. In some embodiments, the number of repetitions of each repeating unit may be an integer of 3 to 20 but depends on the structure of the perfluoropolyether group. The average molecular weight (weight average molecular weight) of Rp may be in the range of 500 to 5000, for example, in the range of 500 to 2000. When the average molecular weight of Rp is 500 or more, a sufficient liquid repellency can be exhibited. When the average molecular weight of Rp is 5000 or less, the compound can be sufficiently dissolved in a solvent. The compound having a perfluoropolyether group is often a mixture of compounds varying in number of repeating units due to the nature of the compound. The number average molecular weight of the perfluoropolyether group is the average total molecular weight of the portions represented by the respective repeating units in formula (14). The average molecular weight used herein is the value measured by gel permeation chromatography (GPC).

Examples of the hydrolyzable substituent represented by X include a halogen atom, an alkoxy group, an amino group, or a hydrogen atom. Beneficially, X represents an alkoxy group having a carbon number in the range of 1 to 6, such as methoxy, ethoxy, or propoxy. These alkoxy groups do not inhibit cationic polymerization even when released by hydrolysis, thus allowing easy reaction control. Y and R may each be an alkyl group having a carbon number in the range of 1 to 20 or the phenyl group. Examples of the alkyl group represented by Z include methyl, ethyl, propyl, and other alkyl groups having a carbon number in the range of 1 to 20. The linking members represented by $Q^1$ and $Q^2$ may each be a carbon atom or a nitrogen atom. Examples of the divalent organic group represented by A include methylene, ethylene, propylene, butylene, methyleneoxy, ethyleneoxy, propyleneoxy, and other alkylene and alkyleneoxy groups having a carbon number in the range of 1 to 12. These groups may have a substituent.

More specifically, examples of the hydrolyzable silane compound having a perfluoropolyether group include the compounds represented by the following formulas (15) to (19):

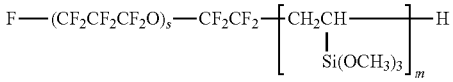

(15)

wherein in formula (15), s represents an integer of 1 to 30, and m represents an integer of 1 to 4;

$$F—(CF_2CF_2CF_2O)_t—CF_2CF_2—CH_2O(CH_2)_3—Si(OCH_3)_3 \quad (16)$$

wherein in formula (16), t represents an integer of 1 to 30;

$$(H_3CO)_3Si—CH_2CH_2CH_2—OCH_2CF_2—(OCF_2CF_2)_e—(OCF_2)_f—OCF_2CH_2O—CH_2CH_2CH_2—Si(OCH_3)_3 \quad (17)$$

wherein in formula (17), e and f each represent an integer of 1 to 30;

(18)

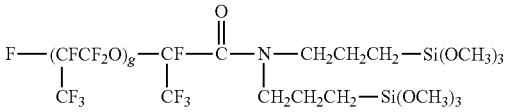

wherein in formula (18), g represents an integer of 1 to 30;

(19)

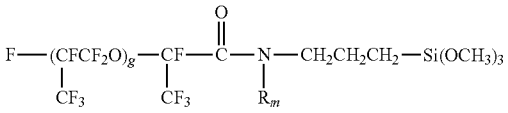

wherein in formula (19), $R_m$ represents a methyl group or a hydrogen atom, and h represents an integer of 1 to 30.

In formulas (15) to (19), each of the numbers s, t, e, f, g, and h of repetitions of the respective repeating units may be in the range of 3 to 30 and is beneficially in the range of 5 to 20. When the number of repetitions of each repeating unit is 3 or more, the liquid repellency of the compound tends to increase; and when the number of repetitions is 30 or less, the solubility of the compound in a solvent tends to increase. If a condensation reaction is made in a fluorine-free solvent, such as an alcohol, it is beneficial that the numbers s, t, e, f, g, and h of repetitions of the respective repeating units are each in the range of 3 to 10.

Some hydrolyzable silane compounds having a perfluoropolyether group are commercially available, and examples thereof include Optool DSX and Optool AES, each produced by Daikin Industries; KY-108 and KY-164, each produced by Shin-Etsu Chemical; Novec 1720 produced by 3M; and Fluorolink S10 produced by Solvay.

In some embodiments, the compound represented by formula (19) shown above may be used as the hydrolyzable silane compound having a perfluoropolyether group.

The hydrolyzable silane compound having a fluorine-containing group may be any one of the above-cited hydrolyzable silane compounds or a combination of two or more of the hydrolyzable silane compounds.

The cationically polymerizable group of the hydrolyzable silane compound having a cationically polymerizable group may be an epoxy group or an oxetane group. In some embodiments, the epoxy group may be used as the cationically polymerizable group in view of availability and reaction control.

The hydrolyzable silane compound having a cationically polymerizable group may be a compound represented by the following formula (20):

$$R_c—SiX_bY_{3-b} \quad (20)$$

wherein in formula (20), $R_c$ represents a nonhydrolyzable substituent having a cationically polymerizable group, X represents a hydrolyzable substituent, Y represents a nonhydrolyzable substituent, and b represents an integer of 1 to 3.

In addition to the hydrolyzable silane compound having a fluorine-containing group and the hydrolyzable silane compound having a cationically polymerizable group, an alkyl- or aryl-substituted or an unsubstituted hydrolyzable silane compound may be condensed together from the viewpoint of controlling the physical properties of the liquid-repellent layer 7.

The alkyl- or aryl-substituted hydrolyzable silane compound may be represented by the following formula (21):

$$R_a\text{-}SiX_{(4-c)} \quad (21)$$

wherein in formula (21), $R_a$ represents a nonhydrolyzable substituent selected from the group consisting of substituted or unsubstituted alkyl groups and substituted or unsubstituted aryl groups, X represents a hydrolyzable substituent, and c represents an integer of 0 to 3.

More specifically, examples of the compound represented by formula (21) include tetramethoxysilane, tetraethoxysilane, tetrapropoxysilane, methyltrimethoxysilane, methyltriethoxysilane, methyltripropoxysilane, ethyltrimethoxysilane, ethyltriethoxysilane, ethyltripropoxysilane, propyltrimethoxysilane, propyltriethoxysilane, propyltripropoxysilane, phenyltrimethoxysilane, phenyltriethoxysilane, phenyltripropoxysilane, diphenyldimethoxysilane, diphenyldiethoxysilane, dimethyldimethoxysilane, and dimethyldiethoxysilane.

The composition of the resulting condensate, or the proportions of the hydrolyzable silane compound having a fluorine-containing group, the hydrolyzable silane compound having a cationically polymerizable group, and the alkyl- or aryl-substituted or unsubstituted hydrolyzable silane compound in the composition is appropriately determined according to the use of the condensate. The proportion of the hydrolyzable silane compound having a fluorine-containing group may be in the range of 0.5% by mole to 20% by mole, for example, 1% by mole to 10% by mole, relative to the total moles of all the hydrolyzable silane compounds. When the hydrolyzable silane compound having a fluorine-containing group is added in a proportion of 0.5% by mole or more, the condensate exhibits a high liquid repellency, and when the proportion of this hydrolyzable silane compound is 20% by mole or less, a layer 12 that will be formed into the liquid-repellent layer (hereinafter referred to as liquid-repellent layer precursor layer 12) can be uniformly formed. When the liquid-repellent layer precursor layer 12 has a satisfactorily even surface, the surface does not scatter the light used for patterning for forming the ejection openings 5, and highly precise patterning can be made.

Furthermore, the ratio of the hydrolyzable silane compound having a cationically polymerizable group to the alkyl- or aryl-substituted or unsubstituted hydrolyzable silane compound may be in the range of 10:1 to 1:10.

The condensate is prepared by hydrolysis of the hydrolyzable silane compound having a fluorine-containing group and the hydrolyzable silane compound having a cationically polymerizable group, and optionally the alkyl- or aryl-substituted or unsubstituted hydrolyzable silane compound, in the presence of water.

The condensation degree of the resulting product can be appropriately controlled by varying the temperature, the pH, and other factors of the condensation reaction. A metal alkoxide may be used as a catalyst for controlling the condensation degree as the result of the hydrolysis. Examples of the metal alkoxide include aluminum alkoxides, titanium alkoxides, and zirconium alkoxides and complexes thereof, such as acetyl acetone complex.

(b) Compound Having a Cationically Polymerizable Group and an Ethylene Oxide Chain Component (b) is a compound capable of imparting an antistatic property to the liquid-repellent layer 7. Component (b) is electrically conductive because of the presence of the ethylene oxide chain and can impart an antistatic property even in a small amount. Also, the cationically polymerizable group of component (b) reacts with the cationically polymerizable group of component (a) or the condensate so that component (b) is incorporated into the condensate. Consequently, the antistatic compound becomes difficult to remove from the liquid-repellent layer 7 even though the surface of the liquid ejection head is subjected to rinsing or wiping. Thus, the liquid-repellent layer 7 can maintain an antistatic property for a long time. Furthermore, component (b) is compatible with the liquid-repellent component, or component (a) that is the condensate of the hydrolyzable silane compound having a fluorine-containing group and the hydrolyzable silane compound having a cationically polymerizable group, and, therefore, components (a) and (b) are uniformly dispersed over the surface of the liquid ejection head. Consequently, unlike the case of using an electrically conductive compound, portions that are absent from the liquid-repellent component are not likely to occur at the surface of the liquid ejection head, and thus component (a) is not likely to be exhibited from exhibiting a liquid repellency.

The cationically polymerizable group of the compound of component (b) may be located at an end of the molecule of the compound and is beneficially at one end of the molecule.

The length of the ethylene oxide chain of component (b), that is, the number of ethylene oxide units of the chain, may be in the range of 2 to 10. When the number of ethylene oxide units is two or more, a satisfactory antistatic property is exhibited. When the number of ethylene oxide units is 10 or less, component (b) is not likely to inhibit component (a) from exhibiting a liquid repellency, allowing the liquid-repellent layer 7 to have a satisfactory liquid repellency.

The cationically polymerizable group may be an epoxy group or an oxetane group. In some embodiments, the cationically polymerizable group of component (b) is the same as the cationically polymerizable group of the hydrolyzable silane compound having a cationically polymerizable group in view of reproductivity.

The compound having a cationically polymerizable group and an ethylene oxide chain may be any one of the compounds represented by the following formulas (1) to (8):

(1)

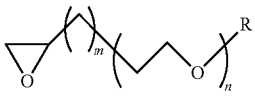

(2)

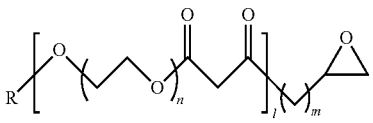

(3)

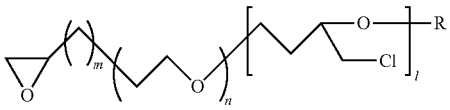

(4)

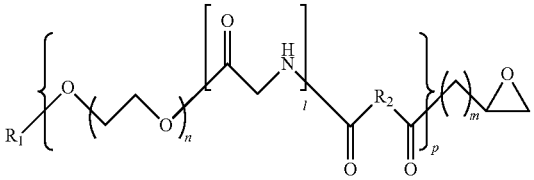

-continued (5)

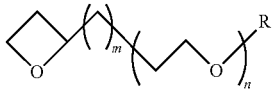

(6)

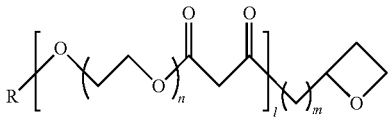

(7)

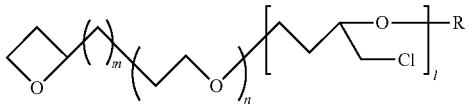

(8)

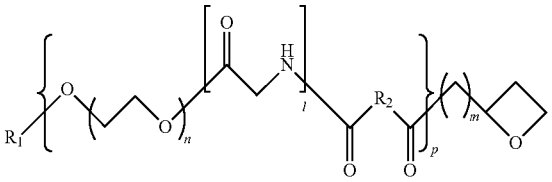

In formulas (1) to (8), m represents an integer of 0 or more, n represents an integer of 2 to 10, l and p each represent an integer of 1 or more, R and $R_1$ each represent a hydrogen atom or an alkyl group, and $R_2$ represents an alkylene group. Examples of the alkyl group represented by R or $R_1$ in formulas (1) to (8) include methyl, ethyl, propyl, and other alkyl groups having a carbon number in the range of 1 to 4. Beneficially, $R_1$ is a hydrogen atom. The alkylene group represented by $R_2$ may have a carbon number in the range of 1 to 4 and may be a methylene group or an ethylene group. Beneficially, $R_2$ is a methylene group. m may be an integer of 0 to 2, and n may be an integer of 2 to 6. l may be an integer of 1 to 3, and p may be an integer of 1 to 3.

The proportions of components (a) and (b) in the composition may be appropriately determined according to the compounds used. The proportion of component (b) in the composition may be 0.05% by mass or more, for example, 0.5% by mass or more, and may be 5% by mass or less, for example, 3% by mass or less, relative to the mass of component (a). When the proportion of component (b) in the composition is 0.05% by mass or more relative to the mass of component (a), a satisfactory antistatic property is obtained. When the proportion of component (b) in the composition is 5% by mass or less relative to the mass of component (a), a satisfactory liquid repellency is obtained. The amount by mole of component (b) in the composition may be smaller than or equal to the amount by mole of the hydrolyzable silane compound having a fluorine-containing group and may be, for example, 50% or less and 10% or more to the amount by mole of the hydrolyzable silane compound having a fluorine-containing group. When the amount by mole of component (b) is smaller than or equal to the amount by mole of the hydrolyzable silane compound having a fluorine-containing group, the fluorine component is not likely to be inhibited from exhibiting liquid repellency. Consequently, the resulting liquid-repellent layer 7 can be favorably repellent to liquid. Also, when the amount by mole of component (b) is 10% or more relative to the amount by mole of the hydrolyzable silane compound having a fluorine-containing group, a satisfactory antistatic property is obtained.

Method for Manufacturing Recording Head

The method for manufacturing the recording head according to an embodiment will now be described with reference to FIGS. 3A to 3G.

FIGS. 3A to 3G are schematic sectional views illustrating the process steps of the method for manufacturing a recording method according to an embodiment of the present disclosure, and each section of the figures corresponds to the sections shown in FIGS. 2A and 2B.

Figure 3A:
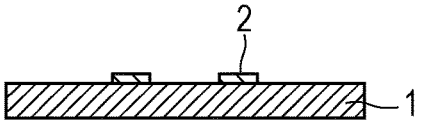
FIGS. 3A to 3G are schematic sectional views illustrating a method for manufacturing a liquid ejection head according to an embodiment of the present disclosure.

First, a substrate 1 provided with energy generating elements 2 on the surface thereof is prepared as shown in FIG. 3A. A control signal input electrode (not shown) is connected to the energy generating elements 2 for operating the energy generating elements 2. The substrate 1 may be further provided with a protective layer intended to enhance the durability of the energy generating elements 2, an adhesion enhancing layer intended to enhance the adhesion between the ejection opening member 4 (or the flow channel member 8) and the substrate 1, or any other function layer.

Figure 3B:
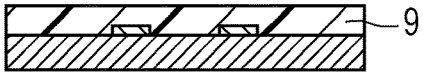

Subsequently, a photosensitive resin layer 9 is formed over the surface of the substrate 1 having the energy generating elements 2, as shown in FIG. 3B. The photosensitive resin layer 9 is what is called a positive photosensitive resin layer. The photosensitive resin layer 9 may be formed by a general-purpose solvent coating method, such as spin coating or slit coating.

Figure 3C:
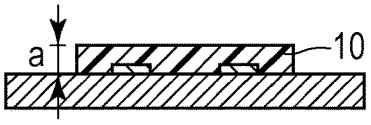

Then, the photosensitive resin layer 9 is formed (patterned) into a pattern 10 by photolithography, as shown in FIG. 3C. The pattern 10 is used as a template for forming the ink flow channels 6. The pattern 10 may be defined by a single-layer or a multilayer structure of the positive photosensitive resin or by a composite including layers made of different materials.

Figure 3D:
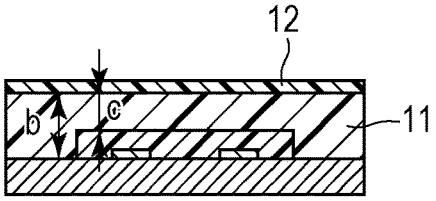

Another photosensitive resin layer 11 that will be formed into the ejection opening member 4 is formed over the substrate 1 having the flow channel pattern 10, as shown in FIG. 3D. This photosensitive resin layer 11 is what is called a negative photosensitive resin layer. The photosensitive resin layer 11 is formed by applying a composition containing a photosensitive resin by spin coating, roll coating, slit coating, or the like. The composition may contain a photo-cationic polymerization initiator and a photosensitive resin having a cationically polymerizable group. The photosensitive resin having a cationically polymerizable group is caused to react and bind with the cationically polymerizable group of component (a) or the condensate in a liquid-repellent layer precursor layer 12 (described herein later) by simultaneously curing the photosensitive resin layer 11 and the liquid-repellent layer precursor layer 12. For example, if the cationically polymerizable group is the epoxy group, an ether linkage is formed. Consequently, the photosensitive resin layer 11 and the liquid-repellent layer precursor layer 12 are firmly bound, so that the resulting liquid-repellent layer 7 does not separate easily from the ejection opening member 4 and exhibits a high durability. At this time, the cationically polymerizable group of component (b) or the compound having an ethylene oxide chain also reacts and binds to the cationically polymerizable group in the photosensitive resin layer 11. Consequently, the compound having an ethylene oxide chain is firmly bound to the underlying layer to maintain an antistatic property for a long time.

An epoxy resin may be used as the photosensitive resin in view of high mechanical strength, adhesion to the underlying layer, resistance to ink, definition of precise patterning for forming ejection openings 5, and other properties.

The epoxy resin may be a product of a reaction between bisphenol A and epichlorohydrin, having a molecular weight of about 900 or more, or a product of a reaction between bromine-containing bisphenol A and epichlorohydrin. A product of a reaction between phenol novolac or o-cresol novolac and epichlorohydrin may be used. Also, a multifunctional epoxy resin having an oxycyclohexane skeleton, disclosed in Japanese Patent Laid-Open Nos. 60-161973, 63-221121, 64-9216, and 2-140219 may be used. The epoxy resin is however not limited to these. The epoxy equivalent weight of the epoxy resin may be 2000 or less, for example, 1000 or less. If the epoxy equivalent weight exceeds 2000, the crosslink density resulting from the curing reaction of the resin decreases, and a problem with adhesion or resistance to ink may occur.

The photo-cationic polymerization initiator used for curing the epoxy resin may be a compound capable of generating an acid by irradiation with light. For example, such a compound may be, but is not limited to, an aromatic sulfonium salt or an aromatic iodonium salts. Examples of the aromatic sulfonium salt include TPS-102, TPS-103, TPS-105, MDS-103, MDS-105, MDS-205, MDS-305, DTS-102, and DTS-103, each available from Midori Kagaku. SP-170 and SP-172 available from Adeka may also be used. Examples of the aromatic iodonium salt include DPI-105, MPI-103, MPI-105, BBI-101, BBI-102, BBI-103, and BBI-105, each available from Midori Kagaku. The photo-cationic polymerization initiator content may be adjusted so that a desired sensitivity can be obtained. For example, the photo-cationic polymerization initiator content may be 0.5% by weight to 5% by weight relative to the epoxy resin content. The photosensitive resin layer composition may optionally contain a wavelength sensitizer, such as SP-100 available from Adeka.

The composition may further contain one or more additives as needed. For example, a flexibility imparting agent may be added for reducing the elastic modulus of the epoxy resin, or a silane coupling agent may be added for enhancing the adhesion of the resulting layer to the underlying layer.

Next, a composition containing the above-described components (a) and (b) is applied onto the photosensitive resin layer 11 by, for example, spin coating, roll coating, or slit coating to form a liquid-repellent layer precursor layer 12.

Figure 3E:
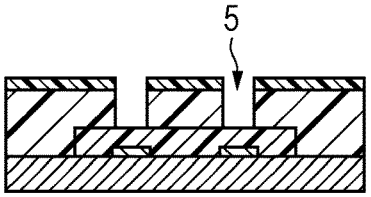

Then, the photosensitive resin layer 11 and the liquid-repellent layer precursor layer 12 are patterned by exposure with a mask (not shown) and development. Thus, ejection openings 5 are formed in the photosensitive resin layer 11 and the precursor layer 12 as shown in FIG. 3E. The simultaneous exposure and development of the photosensitive resin layer 11 and the liquid-repellent layer precursor 12 facilitate the reaction of the cationically polymerizable groups in both layers and helps the formation of a durable, antistatic liquid-repellent layer 7. The flow channel pattern 10 may be dissolved and eliminated in this step. In this step, i-line exposure light may be used. In general, i-line sources that emit light having a center wavelength of 365 nm with a half width of about 5 nm are widely used. A commercially available i-line stepper may be used as the irradiation apparatus.

Figure 3F:
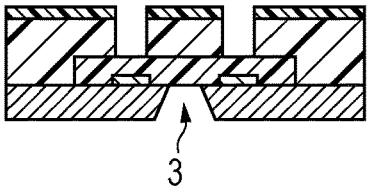

Subsequently, an ink supply port 3 passing through the substrate 1 is formed as shown in FIG. 3F. The ink supply port 3 may be formed by anisotropic etching using an etching mask of a resin composition resistant to the etchant.

Figure 3G:
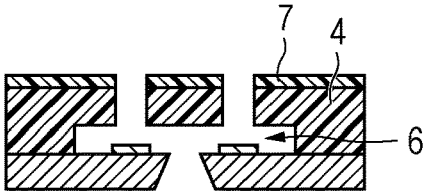

Then, the pattern 10 is removed to form ink flow channels 6, as shown in FIG. 3G. The resulting structure is further subjected to optional heat treatment, connection to a member configured for use to supply ink (not shown), and electrical connection (not shown) for driving the energy generating elements 2 to complete the recording head.

Recording Method

The recording method according to an embodiment of the present disclosure includes ejecting a liquid containing a pigment dispersed in the liquid with a charged dispersant or resin, or a liquid containing a self-dispersible pigment having a surface to which a charged chemical group is bound directly or with an atomic group therebetween onto a recording medium by using the recording head, thus recording an image on the recording medium.

The recording head can be used for ejecting a variety of liquids and is particularly suitable for use to form an image on a recording medium with an ink (liquid) containing a pigment. In many of the inks containing a pigment, the pigment particles are stabilized in a liquid by electrostatic repulsion. In inks of this type, the pigment may be dispersed with a charged dispersant or resin, or a self-dispersible pigment having a surface to which a charged chemical group is bound directly or with an atomic group therebetween may be contained. These pigment inks are charged and are therefore likely to adhere to the liquid-repellent layer 7 due to positive charges unevenly accumulated locally at the surface of the recording head having the ejection openings and provided with the liquid-repellent layer 7. The liquid-repellent layer 7 of the recording head according to an embodiment of the present disclosure maintains an antistatic property over a long time, thus preventing ink from adhering the liquid-repellent layer 7 even when a pigment ink is used.

EXAMPLES

The subject matter of the present disclosure will be further described with reference to the following Examples.

Production of Recording Head

Example 1

An ink jet head was produced in accordance with the process shown in FIGS. 3A to 3G.

First, electrothermal conversion elements (heaters made of $HfB_2$) as energy generating elements 2 and a silicon substrate 1 were prepared as shown in FIG. 3A. The silicon substrate 1 included a multilayer film (not shown) made of SiN and Ta in which ink flow channels 6 were to be formed.

Then, a photosensitive resin layer 9 was formed over the substrate 1 as shown in FIG. 3B by applying a positive photosensitive resin (ODUR produced by Tokyo Ohka Kogyo) by spin coating and baking the coating at 120° C. for 3 minutes. The photosensitive resin layer 9 over the substrate 1 has a thickness of 14 μm.

Subsequently, the photosensitive resin layer 9 was subjected to patterning. For this patterning, the photosensitive resin layer 9 was exposed at a dose of 30000 mJ/cm$^2$ with an exposure device Deep-UV UX-3000 manufactured by Ushio. Then, the exposed layer was developed with methyl isobutyl ketone and rinsed with isopropyl alcohol to yield a pattern 10 having a thickness ("a" in the figure) of 14 μm, as shown in FIG. 3C.

Subsequently, a negative photosensitive resin composition for forming an ejection opening member 4 was applied by spine coating to form a photosensitive resin layer 11, as shown in FIG. 3D. The negative photosensitive resin composition used is shown in the following Table 1. The values in Table 1 are each represented by parts by mass. The thickness of photosensitive resin layer 11 was 20 μm from the surface of the substrate 1 ("b" in FIG. 3D) and 10 μm from the surface of the pattern 10 ("c" in the figure).

TABLE 1

| Negative photosensitive resin composition for ejection opening member | | | | | |
|---|---|---|---|---|---|
| Epoxy resin | | Photo-cationic polymerization initiator | | solvent | |
| Name | Parts | Name | Part | Name | Parts |
| EHPE-3150, produced by Daicel | 50 | SP-172, produced by Adeka | 1 | Methyl isobutyl ketone | 50 |

Subsequently, a liquid-repellent layer precursor layer 12 was formed over the photosensitive resin layer 11 by spin coating. For the composition for forming the precursor layer 12, a condensate described below was used as component (a), and 0.24 g (0.0024 mol) of the compound represented by the following formula (22) was used as the compound having a cationically polymerizable group and an ethylene oxide chain or component (b).

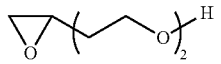

(22)

The condensate was synthesized as described below. The mixture of 27.84 g (0.1000 mol) of γ-glycidoxypropyltriethoxysilane, 17.83 g (0.1000 mol) of methyltriethoxysilane, 3.35 g (0.0047 mol) of perfluorodecylethyltriethoxysilane, 16.58 g of water, and 30.05 g of ethanol was stirred at room temperature for 5 minutes and then refluxed for 48 hours to yield a condensate of a hydrolyzable silane compound having a fluorine-containing group and a hydrolyzable silane compound having a cationically polymerizable group. The theoretical solids content in this instance was 28% with the assumption that all the hydrolyzable groups of the hydrolyzable silane compounds were hydrolyzed and condensed. The condensation degree of the condensate was measured by $^{29}$Si-NMR and was 80%.

Subsequently, the photosensitive resin layer 11 and the liquid-repellent layer precursor layer 12 were subjected to patterning for forming the ejection openings 5, as shown in FIG. 3E. The patterning was performed at an exposure dose of 5000 J/m$^2$ by using an i-line stepper FPA-3000i5+ manufactured by Canon as an exposure device. Then, the exposed layers were developed with methyl isobutyl ketone, rinsed with isopropyl alcohol, and heated at 100° C. for 60 minutes. Thus, the ejection openings 5 were formed. In this Example, each shape of the ejection opening pattern of the mask used for the exposure was circular. In this step, the pattern 10 remained without being developed, and the shape thereof maintained even after the exposure and development for forming the ejection openings 5.

Subsequently, an etching mask (not shown) was formed at the rear surface of the substrate 1, and an ink supply port 3 was formed as shown in FIG. 3F by anisotropic etching. For this operation, the surfaces defining the ejection openings of the photosensitive resin layer 11 were covered with a protective film (PBC manufactured by Tokyo Ohka Kogyo) in advance for protection from the etchant.

Subsequently, the protective film was dissolved in xylene for removal, and the entire surface of the pattern 10 was subjected to exposure through the negative resist at a dose of 250000 mJ/cm$^2$ with an exposure device Deep-UV UX-3000 manufactured by Ushio. Subsequently, the resulting structure was immersed in methyl lactate with ultrasonic microwaves to dissolve the pattern 10 for removal (FIG. 3G).

The recording head was thus completed.

Example 2

A recording head was produced in the same manner as in Example 1 except that component (b) was replaced with 0.27 g (0.0024 mol) of the compound represented by the following formula (23):

(23)

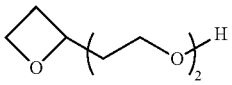

Example 3

A recording head was produced in the same manner as in Example 1 except that component (b) was replaced with 0.48 g (0.0024 mol) of the compound represented by the following formula (24):

(24)

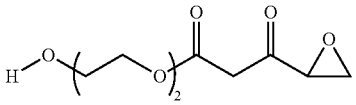

Example 4

A recording head was produced in the same manner as in Example 1 except that component (b) was replaced with 0.55 g (0.0024 mol) of the compound represented by the following formula (25):

(25)

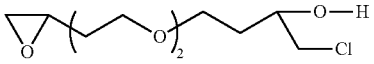

Example 5

A recording head was produced in the same manner as in Example 1 except that component (b) was replaced with 0.64 g (0.0024 mol) of the compound represented by the following formula (26):

(26)

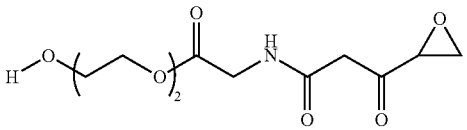

Example 6

A recording head was produced in the same manner as in Example 1 except that the amount of the compound represented by formula (22), or component (b), was varied to 0.54 g (0.0048 mol).

Example 7

A recording head was produced in the same manner as in Example 1 except that the amount of the compound represented by formula (22), or component (b), was varied to 0.027 g (0.00024 mol).

Comparative Example 1

An ink jet recording head was produced in the same manner as in Example 1 except that carbon black was used as component (b) in a proportion of 5% by weight relative to component (a).

Comparative Example 2

A recording head was produced in the same manner as in Example 1 except that component (b) was replaced with 0.25 g (0.0024 mol) of the compound represented by the following formula (27):

(27)

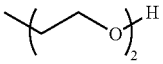

Evaluation

Each of the recording heads produced as above was examined for evaluating the following properties. Examinations for estimating properties were performed as described below, and the results are shown in Table 2.

Pure Water Contact Angle

The dynamic receding contact angle θr of pure water on the liquid-repellent layer of each head was measured with a small contact angle meter DropMeasure manufactured by Microjet. The measurement was performed after a pigment ink was sprayed over the surface of the ejection opening member 4, followed by rinsing with water, and after 5000 times of wiping with a hydrogenated nitrile rubber blade while a pigment ink was being sprayed over the surface. "Initial" and "After durability test" in Table 2 show the results after rinsing and the results after 5000 times of wiping operation, respectively. The results were graded according to the following criteria:

Grading of Pure wWter Contact Angle Test

A: 95° or more

B: 80° or more and less than 95°

C: 70° or more and less than 80°

D: 70° or less

Adhesion

The surface of the ejection opening member 4 was checked for adhesion of ink to the surface under an optical microscope. The adhesion test was performed after rinsing and after 5000 times of wiping operation as in the case of the pure water contact angle measurement. The results were graded according to the following criteria:

Grading of Adhesion Test Results

A: No adhesion of ink

B: Adhered of ink to the surface around the ejection openings occurred at less than 10% of the ejection openings.

C: Adhered of ink to the surface around the ejection openings occurred at 10% or more of the ejection openings.

TABLE 2

| | Component (b) | | | Initial | | After durability test | |
|---|---|---|---|---|---|---|---|
| | Skeleton type | Cationically polymerizable group | Proportion*1 | Pure water contact angle | Adhesion | Pure water contact angle | Adhesion |
| Example 1 | Polyethylene oxide | Epoxy | 50 mol % | A | A | B | A |
| Example 2 | Polyethylene oxide | Oxetane | 50 mol % | A | A | B | A |
| Example 3 | polyether ester | Epoxy | 50 mol % | A | A | B | A |
| Example 4 | polyethylene oxide-epichlorohydrin | Epoxy | 50 mol % | A | A | B | A |
| Example 5 | Polyether ester amide | Epoxy | 50 mol % | A | A | B | A |
| Example 6 | Polyethylene oxide | Epoxy | 100 mol % | B | A | B | A |
| Example 7 | Polyethylene oxide | Epoxy | 5 mol % | A | B | B | B |
| Comparative Example 1 | (Carbon black) | None | 100 wt %*2 | D | A | B | C |
| Comparative Example 2 | Polyethylene oxide | None | 100 mol % | A | A | B | C |

*1Relative to hydrolyzable silane compound having a fluorine-containing group

*2Relative to component (a)

In Comparative Example 1, in which carbon black was used as the antistatic compound, adhesion of ink to the surface of the liquid-repellent layer at the ends of the ejection openings was observed after the durability test. It is assumed that this is because the carbon black was lost from the liquid-repellent layer. In addition, the surface of the ejection opening member did not have a sufficient liquid repellency from the beginning. It is assumed that this is because the carbon black added in a large amount inhibits component (a) from exhibiting liquid repellency. Also, in Comparative Example 1, the pure water contact angle after the durability test was larger than that at the beginning. This is probably because the missing carbon black allows the liquid-repellent layer to exhibit the properties that the liquid-repellent layer should have.

In Comparative Example 2, although the pure water contact angle and the adhesion test result were good at the beginning, adhesion of ink was observed after durability test. Probably, the polyethylene oxide-based compound was lost from the liquid-repellent layer because it did not have a cationically polymerizable group. Unlike the case of Comparative Example 1, the liquid-repellent layer of Comparative Example 2 exhibited a large pure water contact angle at the beginning. This is because the amount of the polyethylene oxide-based compound added was able to be reduced to the extent that the liquid-repellent layer was not inhibited from exhibiting the liquid repellency since the polyethylene oxide-based compound is intrinsically antistatic.

On the other hand, in Examples 1 to 5, the liquid-repellent layer exhibited a large pure water contact angle and no ink adhesion at the beginning and after the durability test.

In Example 6, the pure water contact angle was slightly reduced because the amount of the polyethylene oxide-based compound was increased in comparison with the amount in Example 1. In Example 7, the antistatic property was slightly reduced because the amount of the polyethylene oxide-based compound was reduced in comparison with the amount in Example 1. In both cases, however, the pure water contact angle and the antistatic property were at a relatively high level and were acceptable in practice.

By keeping the antistatic property of the liquid-repellent layer disposed over the surface of the ejection opening member of the liquid ejection head according to the present disclosure, adhesion of liquid to the liquid-repellent layer can be suppressed over a long time.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-151039 filed Aug. 3, 2017 and No. 2018-111475 filed Jun. 11, 2018, which are hereby incorporated by reference herein in their entirety.

What is claimed is:

1. A liquid ejection head comprising:

an ejection opening member having an ejection opening through which a liquid is ejected; and a cured layer of a composition over the surface of the ejection opening member, the composition containing: (a) a condensate of a hydrolyzable silane compound having a fluorine-containing group and a hydrolyzable silane compound having a cationically polymerizable group; and (b) a compound having a cationically polymerizable group and an ethylene oxide chain.

2. The liquid ejection head according to claim 1, wherein the cationically polymerizable group of the compound (b) is at an end of the molecular structure of the compound.

3. The liquid ejection head according to claim 1, wherein the compound (b) is selected from the group consisting of the compounds represented by the following formulas (1) to (8):

(1)

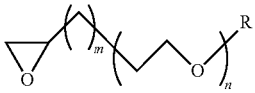

(2)

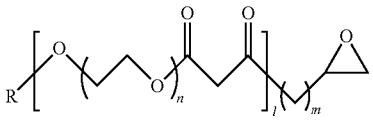

(3)

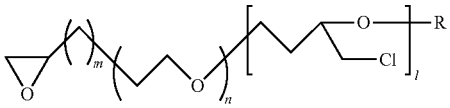

(4)

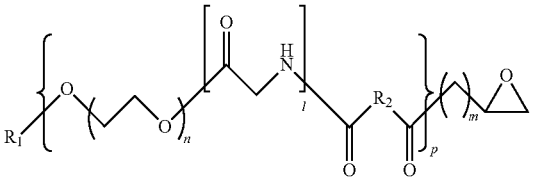

(5)

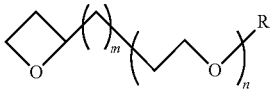

(6)

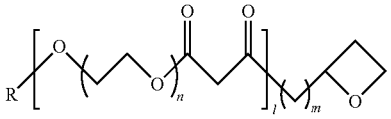

(7)

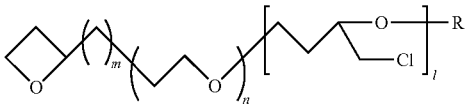

-continued (8)

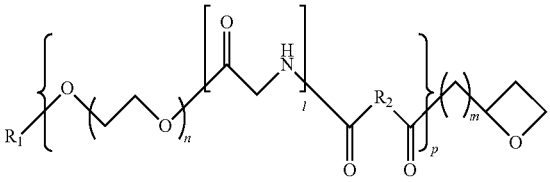

wherein in formulas (1) to (8), m represents an integer of 0 or more, n represents an integer of 2 to 10, l and p each represent an integer of 1 or more, R and $R_1$ each represent a hydrogen atom or an alkyl group, and $R_2$ represents an alkylene group.

4. The liquid ejection head according to claim 1, wherein the ejection opening member is defined by a cured product of a composition containing a photo-cationic polymerization initiator and a photosensitive resin having a cationically polymerizable group.

5. The liquid ejection head according to claim 1, wherein the fluorine-containing group of the hydrolyzable silane compound having a fluorine-containing group is one of a perfluoroalkyl group and a perfluoropolyether group.

6. The liquid ejection head according to claim 1, wherein the amount by mole of the compound (b) in the composition is smaller than or equal to the amount by mole of the hydrolyzable silane compound having a fluorine-containing group.

7. The liquid ejection head according to claim 1, wherein the proportion of the compound (b) to the condensate (a) in the composition is in the range of 0.05% by mass to 3% by mass.

* * * * *